United States Patent [19]

Steiger

[11] Patent Number: 5,061,151

[45] Date of Patent: Oct. 29, 1991

[54] CENTRIFUGAL PUMP SYSTEM WITH LIQUID RING PRIMING PUMP

[75] Inventor: James Steiger, Rockford, Ill.

[73] Assignee: Sundstrand Corporation, Rockford, Ill.

[21] Appl. No.: 483,912

[22] Filed: Feb. 22, 1990

[51] Int. Cl.[5] ..... F01D 3/00

[52] U.S. Cl. ..... 415/106; 415/107; 415/143; 415/169.1; 417/69

[58] Field of Search ..... 415/143, 104, 107, 169.1, 415/106; 417/68, 69

[56] References Cited

U.S. PATENT DOCUMENTS

| | | | |
|---|---|---|---|
| 1,151,964 | 8/1915 | Peterson . | |
| 1,360,576 | 11/1920 | Pitman . | |
| 3,203,354 | 8/1965 | Pedersen | 415/169.1 |
| 3,213,794 | 10/1965 | Adams | 417/69 |
| 3,563,618 | 2/1971 | Ivanov . | |
| 3,671,137 | 6/1972 | Ball . | |
| 3,677,659 | 7/1972 | Williams . | |
| 3,758,226 | 9/1973 | Gyurech . | |
| 3,867,056 | 2/1975 | Carle et al. | 415/169.1 |
| 3,966,351 | 6/1976 | Sproule . | |
| 4,013,384 | 3/1977 | Oikawa . | |
| 4,156,342 | 5/1979 | Korta et al. . | |
| 4,523,900 | 6/1985 | Frey | 415/143 |
| 4,780,050 | 10/1988 | Caine et al. | 415/143 |
| 4,844,691 | 7/1989 | Hallman et al. | 415/169.1 |
| 4,867,633 | 4/1989 | Gravelle | 415/106 |

FOREIGN PATENT DOCUMENTS

| | | | |
|---|---|---|---|
| 0714049 | 2/1980 | U.S.S.R. | 415/143 |

*Primary Examiner*—Edward K. Look
*Assistant Examiner*—Chrisopher M. Verdier
*Attorney, Agent, or Firm*—Wood, Phillips, Mason, Recktenwald & VanSanten

[57] ABSTRACT

The problem of minimizing size and weight parameters in an impeller-type centrifugal pump system (10), including a liquid ring priming pump (32), is solved by providing a housing (12) defining a fluid inlet (26). An impeller (16) is rotatably mounted downstream of the inlet on a rotatable shaft (18). A pressure balance chamber (42) is located behind the impeller to provide for thrust balancing of the impeller. A first passage (44) extends directly through the impeller communicating inlet pressure with the balance chamber. The first passage has an inlet forward of the impeller blades. The liquid ring pump is rotatably mounted on the shaft and is located behind the balance chamber. A second passage (46) communicates the inlet pressure in the balance chamber with the liquid ring pump outside the rotating shaft.

17 Claims, 5 Drawing Sheets

CENTRIFUGAL PUMP SYSTEM WITH LIQUID RING PRIMING PUMP

FIELD OF THE INVENTION

This invention generally relates to centrifugal pumps and, particularly, to an impeller-type pump system having a liquid ring pump for priming the main impeller pump.

BACKGROUND OF THE INVENTION

Liquid pumps are used in many environments or applications. Such devices conventionally include a housing defining a pumping chamber or cavity within which an impeller assembly is rotated. The impeller assembly is mounted on shaft means rotatably journaled within the housing and including radially projecting impeller blades for drawing fluid into an inlet of the housing and out through an outlet. Bearings are provided about the impeller shaft often behind the impeller to journal the shaft within the housing. A pressure balance chamber normally is provided behind the impeller to reduce axial thrust loads thereby increasing the life, or reducing the size or quantity of the thrust bearings. The balance chamber is provided with communicating passageways to inlet or another low pressure reservoir In most instances these passageways are merely holes through the impeller shroud and situated between the inlet end of the impeller vanes where pressure is low. Leakage flow through the passageways reduces the pressure in the balance chamber and thereby reduces the axial thrust load that must be carried by the bearings.

In fuel boost pumps of the character described, it often is desirable to provide a liquid ring pump operatively associated with the main impeller pump for priming the pump system. In other words, where fuel is stored below the level of the impeller pump, the fuel must be lifted up the fuel line to the impeller pump, and the liquid ring pump performs this function.

This invention is directed to providing an impeller-type centrifugal pump system embodying both a pressure balance chamber and a liquid ring priming pump and communicating the chamber and the pump with the inlet side of the impeller means in a seriatum fashion through the balance chamber to the liquid ring pump.

SUMMARY OF THE INVENTION

An object, therefore, of the invention is to provide a new and improved impeller-type pump system incorporating a liquid ring priming pump.

In the exemplary embodiment of the invention, the system includes housing means defining a fluid inlet. Impeller means are rotatably mounted in the housing means downstream of the inlet. The impeller means include an inducer stage forward of a centrifugal impeller stage. A pressure balance chamber is provided behind the impeller means to provide for thrust balancing of the impeller means and its bearings. First passage means extend directly through the impeller means communicating inlet pressure with the pressure balance chamber. The first passage means include inlet means in the inducer stage and outlet means behind the centrifugal impeller stage. A liquid ring pump is provided in the housing for priming the pump system. Second passage means communicate the pressure balance chamber with the liquid ring pump and, thereby, seriatum with the inlet side of the impeller means.

As disclosed herein, the impeller means are journaled in the housing by bearing means located behind the pressure balance chamber. The liquid ring pump is located behind the bearing means. The second passage means extend through the housing means around the bearing means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which:

DETAILED DESCRIPTION OF THE PREFERRED EMBODIMENT

Figure 1:
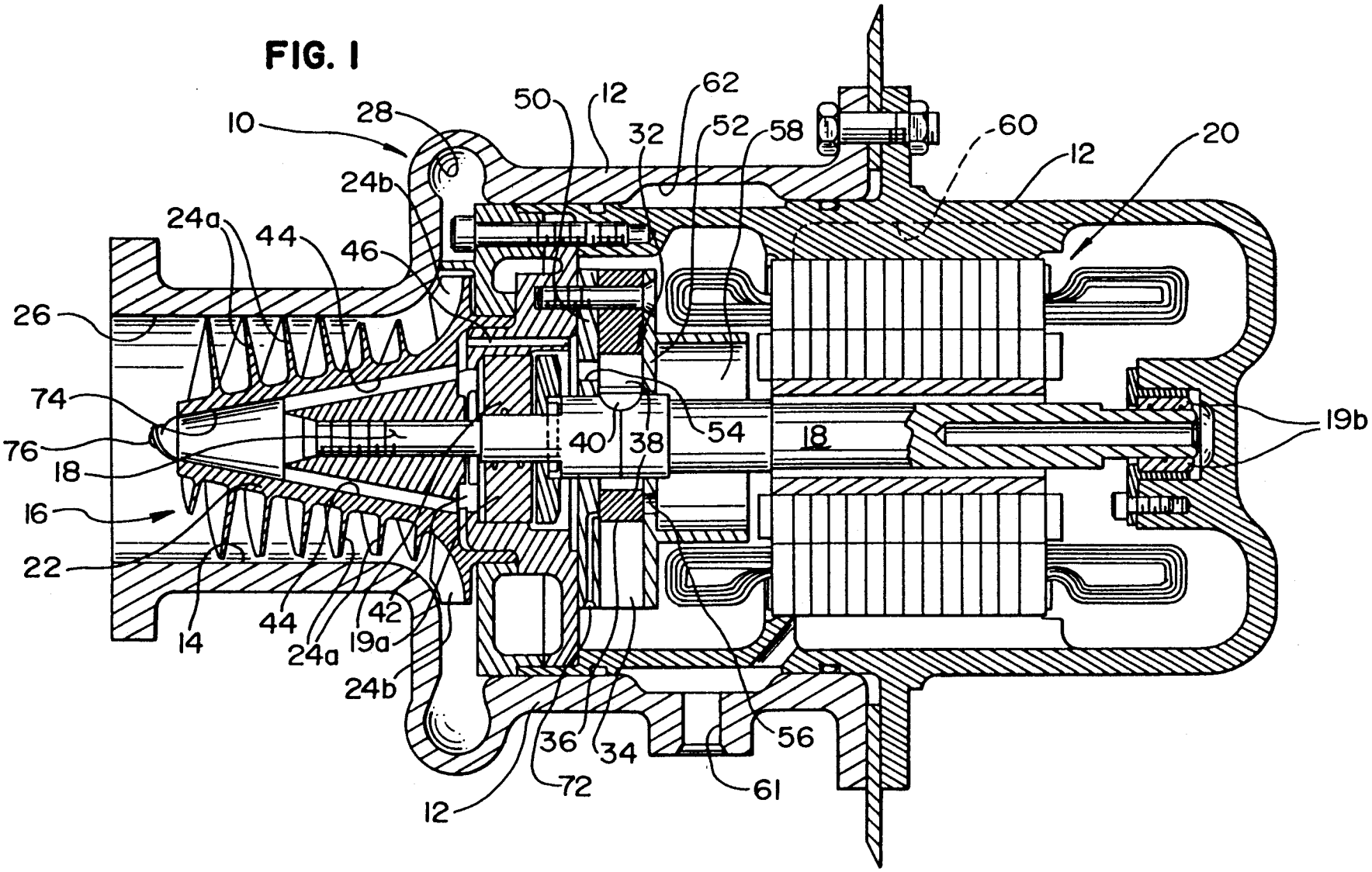
FIG. 1 is an axial section through a pump system incorporating the concepts of the invention.

Referring to the drawings in greater detail, and first to FIG. 1, the invention is embodied in an impeller-type centrifugal pump system, generally designated 10, which includes a housing 12 defining a main pump chamber or cavity 14. At this point, it should be understood that the "housing" is comprised of a number of components for assembly purposes, and the use of that term herein and in the claims hereof is intended to encompass the overall encasing structure for pump system 10.

Impeller means, generally designated 16, are fixed to one end of a shaft 18. The shaft is journalled in the housing by bearings **19*a* and 19*b* and is rotated by a motor means, generally designated 20, located in an aft portion of housing 12. The impeller means include a hub 22 fixed to shaft 18, with impeller blades 24*a* and 24*b* projecting radially outwardly from the hub into pump cavity 14 of housing 12. This impeller pump is the main pump for the system and functions to draw fluid into an inlet 26 of housing 12, through appropriate passage means in the housing, such as at 28**, and out through a discharge or outlet of the housing. The outlet is not visible in the drawings because it is behind the housing as depicted.

The impeller pump is a two-stage pump, in that impeller blades **24*a* define an inducer stage and impeller blade(s) 24*b*** defines a centrifugal impeller stage.

One application for pump system 10 is as a fuel pump wherein inlet 26 would be connected to a fuel line leading to a source of fuel. Often, the fuel source is located below the level of impeller 16 and, consequently, means must be provided for priming this centrifugal pump. In other words, there may be air/gas or vapor in the line at inlet 26, and a centrifugal pump cannot operate on gas.

For this purpose, a liquid ring pump, generally designated 32, is provided behind impeller means 16 and bearings 19*a*, between the bearings and motor 20. The liquid ring pump includes an outer housing portion 34, within main housing 12, defining a pump chamber or cavity 36. Impeller means 38 are fixed to shaft 18 for rotation therewith by a key member 40. As is known, a liquid ring pump has a liquid seal caused by liquid movement outwardly about its impeller blade tips and, consequently, such a pump can operate on gas. As will be seen hereinafter, the liquid ring pump will draw on the fluid at inlet 26 until the gas in the line has been evacuated and the liquid reaches impeller means 16 whereupon it becomes operative.

Figure 2:
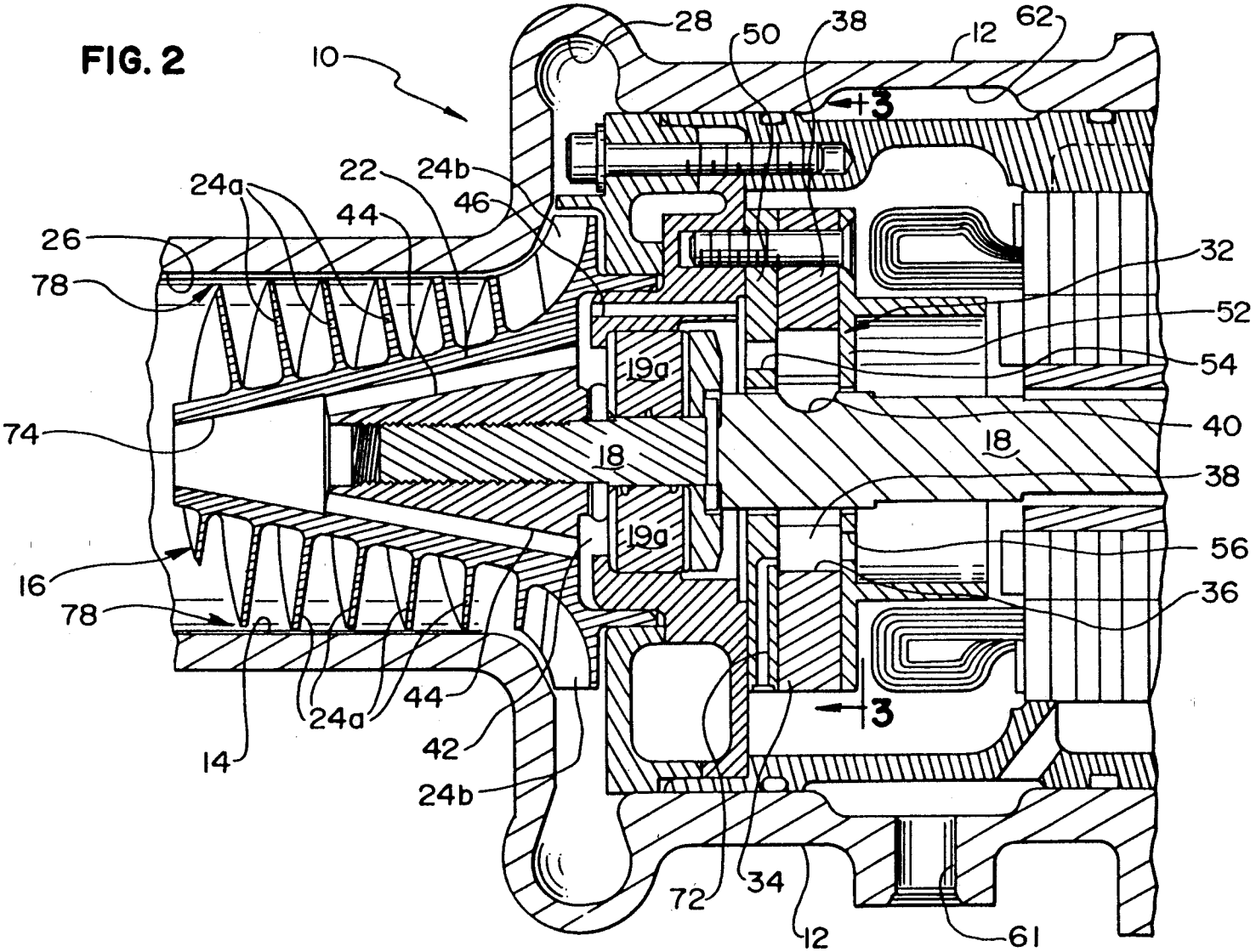
FIG. 2 is an axial section, on an enlarged scale, of an axial portion of the pump of FIG. 1.

Referring to the enlarged view of FIG. 2 in conjunction with FIG. 1, the invention is directed to a system for pressure balancing impeller means 16 and feeding liquid ring pump 32 from the inlet side of the impeller means without in any way increasing the size or weight of the pump system and without adversely affecting the suction performance. In order to pressure balance impeller means 16, a balance chamber 42 is formed behind hub 22 and blades 24*a*, 24*b* of the impeller means 16.

The invention contemplates communicating balance chamber 42 and feeding liquid ring pump 32 from the inlet side of impeller means 16 in a seriatum fashion. More particularly, first passages 44 extend through hub 22 or the "nose" of impeller means 16 to communicate inlet pressure with balance chamber 42 and thereby provide for thrust balancing of the impeller means on bearings 19*a*. As will be described in greater detail hereinafter, if the passages do not extend forward to the nose of the impeller means, the balance chamber pressure would be higher, and the suction and reprime performance may be adversely affected.

Second passages 46 extend through housing 12, radially outwardly of bearings 19*a*, and communicate the balance chamber with liquid ring pump 32. Therefore, the inlet pressure is communicated seriatum directly through the impeller means to the balance chamber and then to the liquid ring pump. It can be seen that shaft 18 remains undisturbed in its solid configuration. In addition, particularly for use in aerospace applications, no outside plumbing is required.

Referring again to liquid ring pump 32, housing portion 34 and impeller means 38 are sandwiched between a pair of inlet and discharge port plates 50 and 52, respectively, having ports 54 and 56, respectively, therethrough. Fluid passes through passages 46 from balance chamber 42, through inlet ports 54 in inlet port plate 50 and to pump cavity 36 of the liquid ring pump. The fluid then passes out through discharge ports 56 in discharge port plate 52 and into a cavity 58 surrounding motor 20. During initial priming operation, this fluid simply is air. However, once the liquid, such as the fuel, is lifted up the fuel line, through inlet 26 to impeller means 16, the main impeller pump defined by impeller means 16 takes over and pumps the fuel through passages 28 in housing 12 and out through an appropriate discharge. Some amount of liquid still passes through the liquid ring pump into motor chamber 58. Eventually, this liquid flows through a passage 60 to a passage 62 and through additional passage means 61 in housing 12 to the fuel tank or low pressure reservoir. This amount of fluid can act as a cooling and lubricating medium about the motor.

Figure 3:
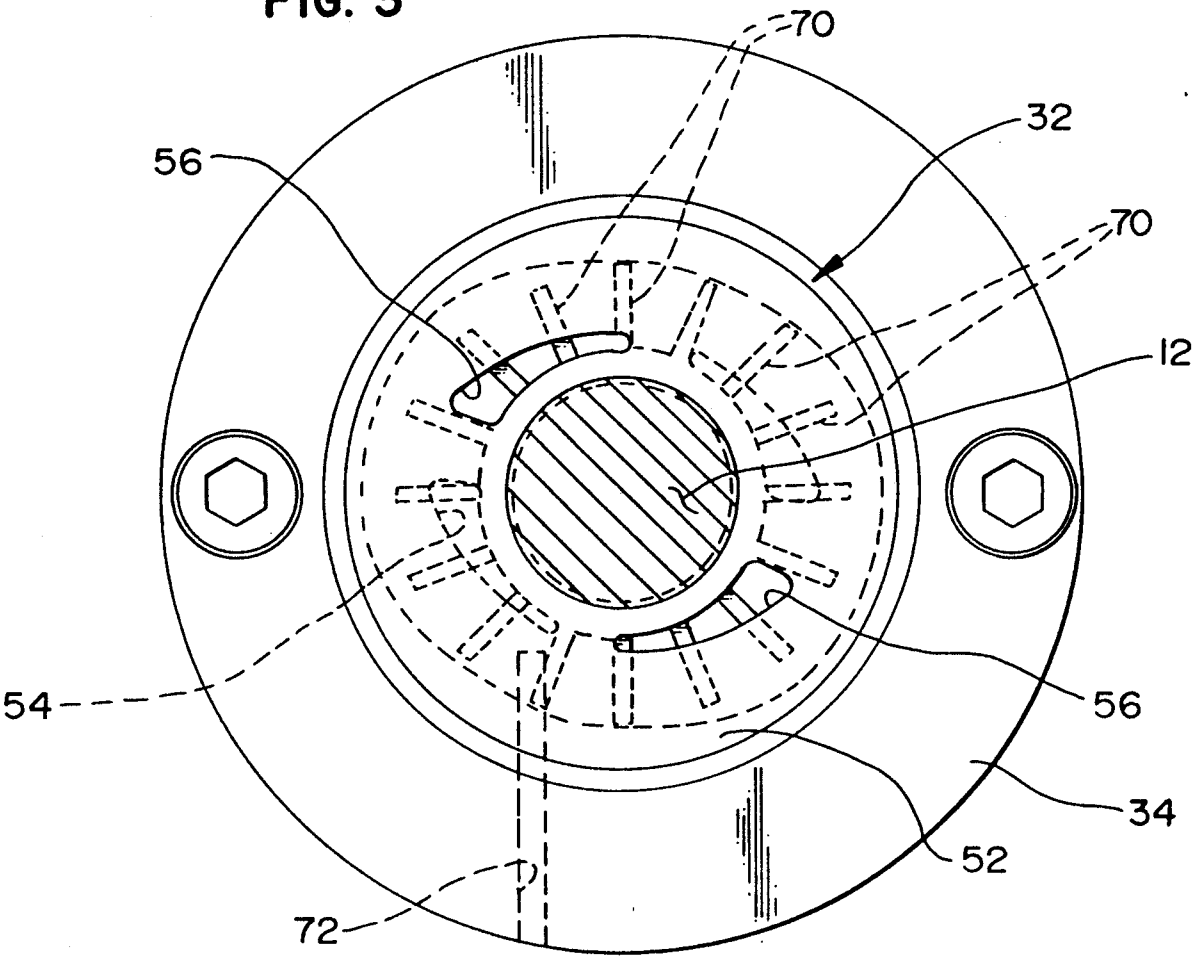
FIG. 3 is a vertical section, on an enlarged scale, taken generally along line 3—3 of FIG. 2.

FIG. 3 is a vertical section taken generally along line 3—3 of FIG. 2 in order to show the location of discharge ports 56 in discharge port plate 52, as well as the location of inlet ports 54, of the liquid ring pump 32 described in relation to FIGS. 1 and 2. The blades of the liquid ring rotor of the liquid ring pump also are indicated at 70 in FIG. 3. A liquid ring refill hole 72 is shown extending through housing portion 34.

In operation, when pump 10 is started or restarted, inlet 26 normally is filled with air or gas, and the fuel which is stored below the level of the pump must be lifted up the fuel line to the pump impeller. This is accomplished by liquid ring pump 32 which, as is known, is capable of pumping a gaseous medium. Should the liquid ring pump lack sufficient liquid, the pump is automatically refilled through refill hole 72 from the normal reservoir of liquid remaining in the various pump cavities. As the gas is evacuated from the fuel line, the liquid fuel eventually reaches impeller means 16 and the inducer stage defined by impeller blades 24*a*. Now that the impeller means is surrounded by liquid, the centrifugal impeller stage, defined by impeller blades 24*b*, is effective to pump the liquid from the fuel line out through passage means 28 and the discharge or outlet of the pump housing.

The invention is significant in that passages 44 extend through hub 22 and a hollow area 74 at the apex or nose of impeller means 16 directly to the inlet pressure. This prevents the initial gaseous medium from flowing toward the outside of impeller blades 24*a* of the inducer stage of the impeller.

In addition, aside from starting and restarting the pump, during operation of the pump, a "cone" 76 (FIG. 1) of gas is prone to form about the apex or front nose end of the impeller means. By communicating passages 44 directly with this area, this accumulated gas is continuously evacuated by liquid ring pump 32. Otherwise, the building up of gas in this area blocks full flow of liquid to the blades of the impeller means.

Figure 4:
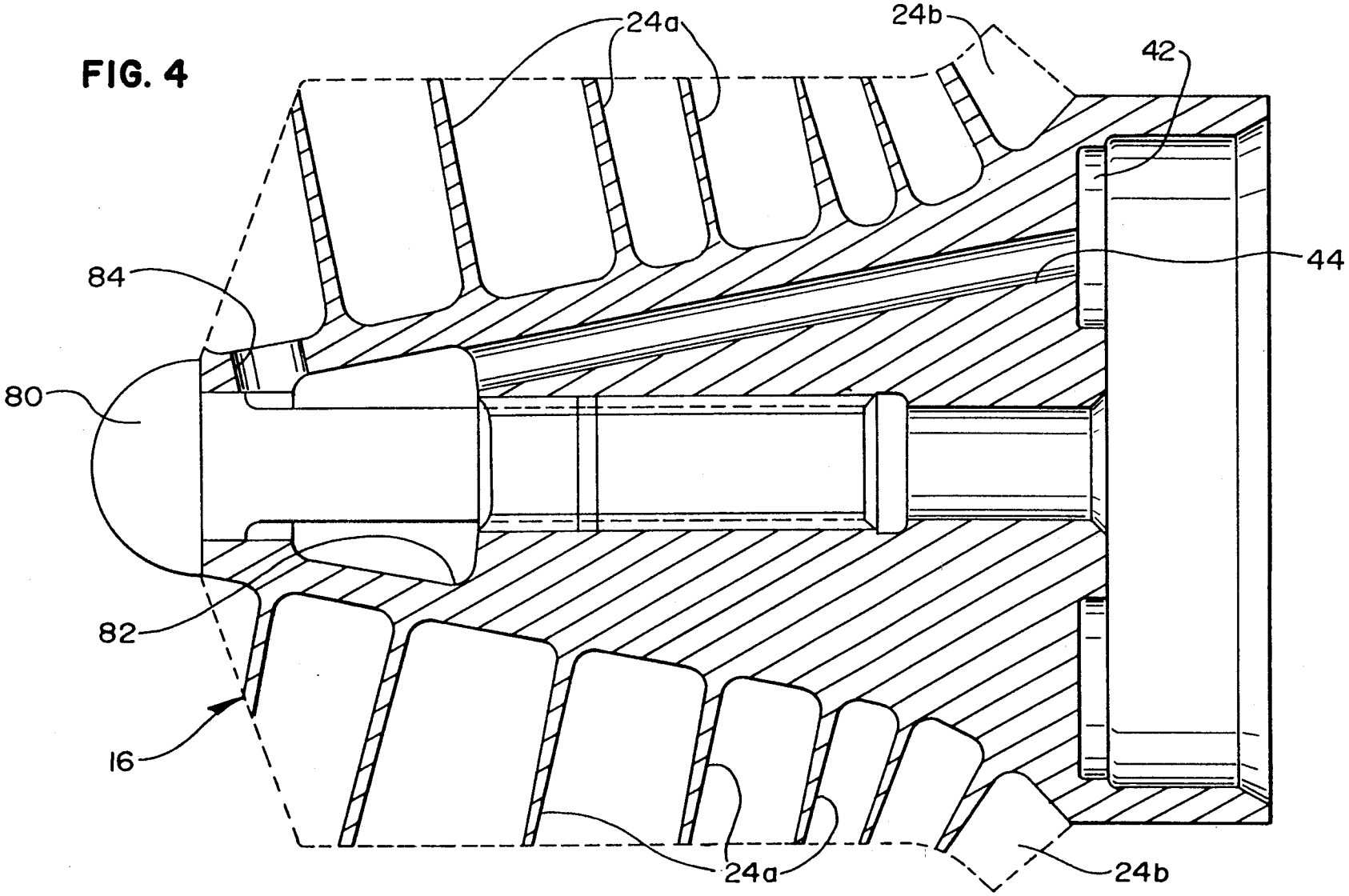
FIG. 4 is an axial section, on an enlarged scale, through a modified form of impeller means according to the invention.
Figure 5:
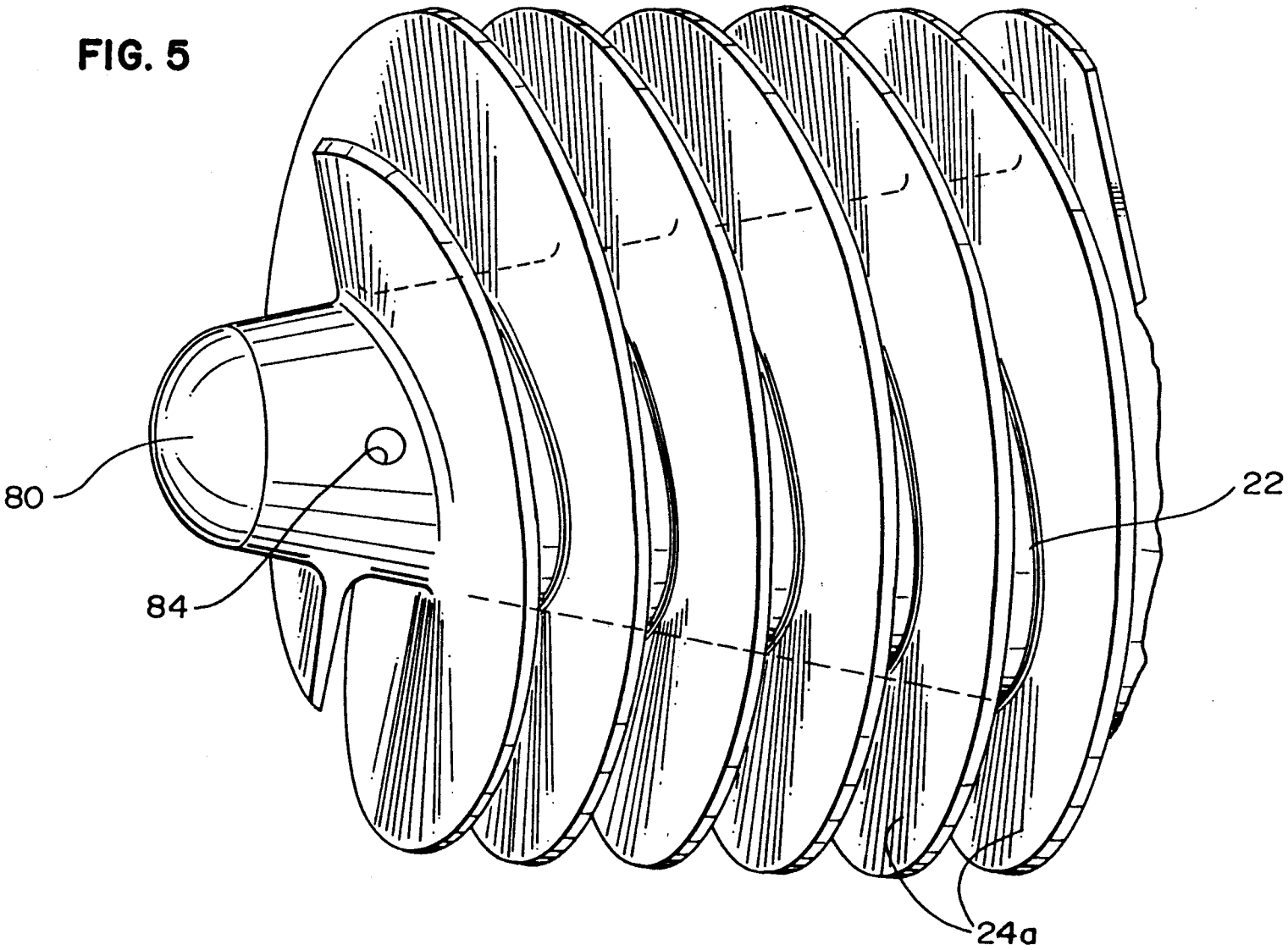
FIG. 5 is a fragmented perspective view of the "nose" portion of the impeller means of FIG. 4.

Before proceeding to the alternate form of the invention shown in FIGS. 4 and 5, referring back to FIG. 2, there is provided a clearance, generally designated at 78, between the profile of impeller means 16 and the surrounding walls of inlet 26. This clearance commonly is termed the "running clearance" of the impeller means and may be on the order of 0.010 inch wide per inch of diameter. In essence, once liquid reaches the point where the blades form a running clearance with the surrounding walls of the inlet, a liquid seal inherently is formed by the liquid. Consequently, by communicating passages 44 through area 74 directly to the inlet pressure in inlet 26, air or gas (which could flow through such a clearance area) is prevented from reaching that area.

To that end, FIGS. 4 and 5 show an alternate form of the invention wherein like numerals are applied to like components described in relation to FIGS. 1 and 2. In this embodiment, impeller means 16 is provided with a solid or closed nose 80. With such an impeller construction, passages 44 communicate with an interior impeller cavity 82 and then communicate with the inlet side of the impeller through a passage 84. However, note that passage 84 still is forward or toward the inlet side of any point where the blades start defining a liquid running clearance with the surrounding walls of the impeller cavity. Therefore, with this alternate form, the gaseous medium still is fed directly through the impeller means to the balance chamber to draw gas or air therethrough without requiring the gas to move to the outside of the impeller blades. Such a centrifugal impeller pump cannot pump liquid in the presence of gas or, at least, the pumping action is inhibited. The embodiments of the invention obviate this type of problem.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An impeller-type pump system, comprising:

housing means defining a fluid inlet;

impeller means rotatably mounted in the housing means downstream of the inlet, the impeller means including an inducer stage forward of a centrifugal impeller stage;

a pressure balance chamber defined in the housing behind the impeller means to provide for thrust balance of the impeller means;

first passage means through the impeller means, including an inlet in the inducer stage and an outlet in the centrifugal impeller stage, communicating pressure at the inlet with the pressure balance chamber;

a liquid ring pump for priming the pump system, the liquid ring pump being located behind the centrifugal impeller means; and second passage means communicating the pressure balance chamber with the liquid ring pump.

2. The impeller-type pump system of claim 1, including bearing means journalling the impeller means in the housing at a location behind the pressure balance chamber, said liquid ring pump being located behind the bearing means, and with said second passage means passing radially outwardly of the bearing means.

3. The impeller-type pump system of claim 2 wherein said second passage means are located in the housing means.

4. The impeller-type pump system of claim 1 wherein said impeller means include a hub, said first passage means extending through the hub.

5. The impeller-type pump system of claim 4 wherein said inducer stage of the impeller means include blade means defining a liquid running clearance between the blade means and the housing means, with said inlet means of the first passage means being located forward of a point where the blade means defines said liquid running clearance.

6. The impeller-type pump system of claim 1 wherein said inducer stage of the impeller means include blade means defining a liquid running clearance between the blade means and the housing means, with said inlet means of the first passage means being located forward of a point where the blade means defines said liquid running clearance.

7. The impeller-type pump system of claim 1 wherein said inducer stage of the impeller means include blade means, and said inlet means of the first passage means are located forward of the blade means.

8. An impeller-type pump system, comprising:

housing means defining a fluid inlet;

impeller means including an inducer stage forward of a centrifugal impeller stage, the inducer stage having blade means defining a liquid running clearance between the blade means and the housing means, and shaft means rotatably mounted in the housing means by bearing means behind the impeller means;

a pressure balance chamber defined in the housing behind the impeller means forward of the bearing means to provide for trust balancing of the impeller means;

first passage means through the impeller means, including an inlet located forward of a point where the blade means define said liquid running clearance, communicating inlet pressure with the pressure balance chamber;

a liquid ring pump in the housing for priming the pump system, the liquid ring pump being driven by said shaft means and being located behind the bearing means on a side thereof opposite the impeller means; and second passage means communicating the pressure balance chamber with the liquid ring pump, the second passage means being located outside the shaft means.

9. The impeller-type pump system of claim 8 wherein said second passage means is located in the housing means and extends around the bearing means.

10. The impeller-type pump system of claim 8 wherein said impeller means include a hub with said blade means thereabout, said first passage means extending through the hub.

11. A centrifugal pump system, comprising:

housing means;

impeller means including an inducer stage forward of a centrifugal impeller stage, the inducer stage having blade means rotatably mounted in the housing means;

a pressure balance chamber defined in the housing behind the impeller means;

first passage means, including an inlet forward of the blade means, communicating the pressure balance chamber with a front side of the impeller means;

a liquid ring pump for priming the pump system, the liquid ring pump being located behind the centrifugal impeller means; and second passage means communicating the pressure balance chamber with the liquid ring pump.

12. The centrifugal pump system of claim 11, including bearing means journaling the impeller means in the housing at a location behind the pressure balance chamber, said liquid ring pump being located behind the bearing means and with said second passage means passing around the bearing means.

13. The centrifugal pump system of claim 12 wherein said second passage means are located in the housing means.

14. The centrifugal pump system of claim 11 wherein said impeller means include a hub with said blade means thereabout, said first passage means extending through the hub.

15. An impeller-type pump system, comprising:

housing means defining a fluid inlet;

impeller means including an inducer stage forward of an impeller stage, the inducer stage having blade means and the impeller means having shaft means rotatably mounted in the housing means by bearing means behind the impeller means;

a pressure balance chamber defined in the housing behind the impeller means forward of the bearing means to provide for thrust balancing of the impeller means;

first passage means through the impeller means, including an inlet forward of the blade means, communicating the inlet with the pressure balancing chamber;

a liquid ring pump in the housing for priming the pump system, the liquid ring pump being driven by said shaft means and being located behind the bearing means on a side thereof opposite the impeller means; and second passage means communicating the pressure balance chamber with the liquid ring pump, the second passage means being located outside the shaft means.

16. The impeller-type pump system of claim 15 wherein said second passage means is located in the housing means and extends around the bearing means.

17. The impeller-type pump system of claim 15 wherein said impeller means include a hub with said blade means thereabout, said first passage means extending through the hub.

* * * * *